United States Patent [19]

Kamal

[11] Patent Number: 4,838,536

[45] Date of Patent: Jun. 13, 1989

[54] FABRIC PICKER AND SEPARATOR

[76] Inventor: Nabil Kamal, 2112 Favreau, Chomedey, Laval, Quebec, Canada, H7T 1V1

[21] Appl. No.: 107,113

[22] Filed: Oct. 13, 1987

[51] Int. Cl.[4] ..... B65H 3/22

[52] U.S. Cl. ..... 271/18.3; 271/168

[58] Field of Search ..... 271/18.3, 168

[56] References Cited

U.S. PATENT DOCUMENTS

| | | | |
|---|---|---|---|
| 2,878,016 | 3/1959 | Russell | 271/168 X |
| 3,386,763 | 6/1968 | Ottaway | 271/18.3 X |
| 3,981,495 | 9/1976 | Bijttebier | 271/18.3 |
| 4,283,047 | 8/1981 | Blessing | 271/18.3 X |
| 4,684,120 | 8/1987 | Kamal | 271/18.3 |

*Primary Examiner*—Richard A. Schacher

[57] ABSTRACT

A fabric picking and transferring device for transferring one or more top fabric plies from a stack of such plies. The device comprises a support body having a fabric engaging end. The housing is displaced toward the stack to position the fabric engaging end on an uppermost ply of the stack. At least two picking needles are supported by the body and each has a pointed engaging end portion. The needles are disposed in opposed offset facing relationship and at a shallow angle with respect to the plane of the uppermost ply, with the pointed engaging end portion retracted inside the fabric engaging end of the body. An actuating mechanism is provided for moving the fabric engaging end of the needles a predetermined distance outwardly of the fabric engaging end with the fabric engaging ends crossing one another, and wherein the needles will penetrate in each of the one or more uppermost fabric plies.

29 Claims, 4 Drawing Sheets

FIG. 8
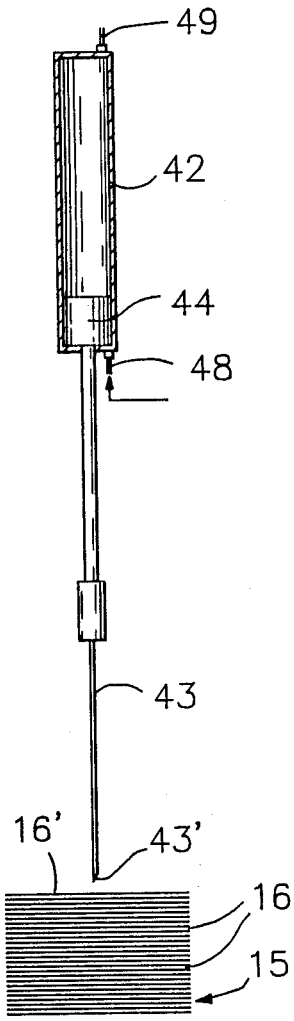
FIG. 9
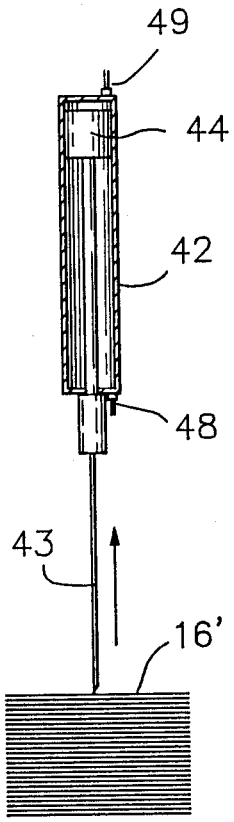
FIG. 10
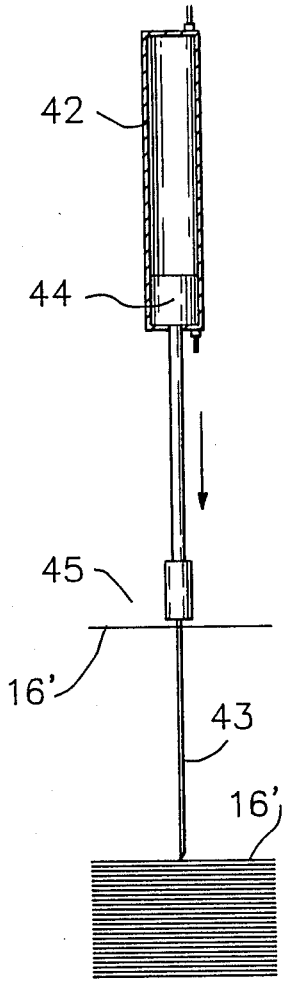
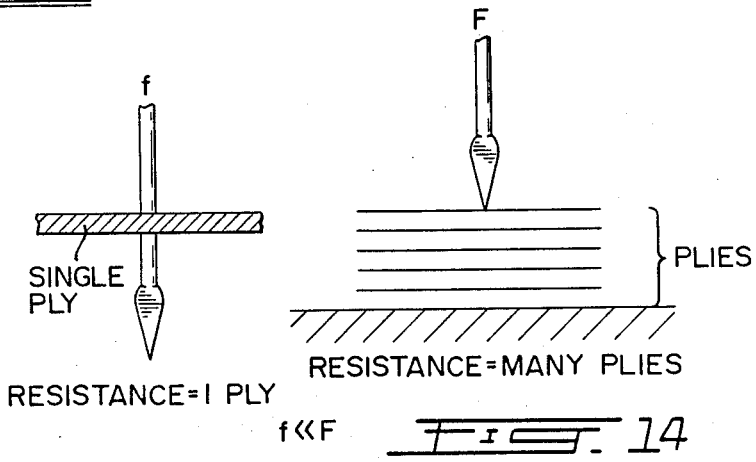
FIG. 14

FABRIC PICKER AND SEPARATOR

BACKGROUND OF INVENTION

1. Field of Invention

The present invention relates to a fabric picking and transferring device and method, for the transferring of one or more top fabric plies from a stack of such plies, and wherein the plies are engaged by at least two opposed picking needles inclined in offset facing relationship and at a shallow angle with respect to the plane of the uppermost ply. In addition, the device includes the combination of one or more separating needles which prevents fabric pieces under the engaged top fabric piece(s) from adhering to the engaged piece(s) when displaced from the stack.

2. Description of Prior Art

Various devices have been constructed in an attempt to transfer one or more top fabric pieces from stacks of fabric pieces and to position these engaged pieces at a remote station where another operation is effectuated. Presently known equipment has not been found satisfactory and the needletrade industry generally relies on manual labor to effect this operation. However, such operation is labor intensive, time consuming, and costly. There is therefore a need to provide an automatic separating and transporting machine wherein single fabric pieces or a few fabric pieces can be separated from the top of a stack of fabric plies without disturbing the underlying layers and transport it to a remote location to be superimposed in precise alignment at an unloading station, either for positioning the fabric pieces on other pieces, or else simply aligning them in position so that an operator can effect another function. Such machines should also be operated with minimum supervision, be precise, operate at high speed, and be capable of being synchronied with other machines in an assembly process.

Some of the devices known to attempt to effect this operation are disclosed in U.S. Pat. No. 3,981,495 and U.S. Pat. No. 4,613,123. These patents describe fabric carrying devices having sharp needle-like projections which move in opposite directions while the machine is pressing on the uppermost ply of a stack of plies whereby the needles engage and stretch the material to tighten and separate the engaged ply from the sub-plies. The disadvantage of such machines is the uncertainty of the separation process without disturbing underlying plies. Also, these machines can damage certain fabrics due to the stretching effected by the picking needles.

U.S. Pat. No. 3,176,979 and International Publication No. WO85/02389 published June 6, 1985 disclose devices to effect a fabric picking operation, but the disadvantage of these devices is that the stack of fabric plies must be perfectly straight and have an even surface in order for the picking mechanism to engage the fabric ply. These devices have not been found satisfactory to separate the engaged ply from the underlying plies without disturbing them. Another problem with these machines is that they cannot handle a stack of fabric plies having plies of various thickness or texture.

There are still other proposed methods for picking an uppermost fabric ply from a stack of plies, and some have suggested pinching and rolling the material through a predetermined space allowing only double of the material thickness to pass whereby the underlying ply would not adhere to the uppermost ply. Another disadvantage of this method is the limitation of picking a single ply only. Also the pinching of the material may leave undesirable marks or curls at the picking points at the edge of the material. Another disadvantage is that this method fails to handle tone-over-tone fabric, in other words, material of different thickness of texture at different locations along the material surface. Such machines require continuous adjustment when using different fabric materials and have been found to be limited to light and flexible materials only. They have not been found satisfactory to solve the problem of full separation without disturbing underlying plies.

SUMMARY OF INVENTION

It is a feature of the present invention to provide a picking and transferring device which substantially overcomes all of the above-mentioned disadvantages of the prior art, and which is capable of picking one or more top fabric plies from a stack of fabric plies without disturbing the underlying plies.

Another feature of the present invention is to provide a picking and transferring device which is also capable of transporting the engaged one or more top fabric plies from a stack of plies to an unloading position while maintaining the engaged fabric plies in precise position.

Another feature of the present invention is to provide a picking and transferring device wherein the material is picked by needles extending in opposed offset relationship and at a shallow angle with respect to the plane of the top fabric ply, and wherein the distance of penetration of the needle is adjustable.

Another feature of the present invention is to provide a picking and transferring device which is fully automatic, which is rapid and precise in operation, and which may be used in different configurations to effect many different operations.

Another feature of the present invention is to provide a picking and transferring device in combination with a separating device to prevent underlying fabric plies from adhering to the engaged one or more top fabric plies.

Another feature of the present invention is to provide a method of picking and transferring one or more top fabric plies from a stack of fabric plies without disturbing underlying fabric plies, and preventing underlying plies to adhere to the picked fabric plies.

Another feature of the present invention is to provide a fabric separating device for preventing underlying plies under one or more engaged uppermost plies of a stack of plies from adhering to the engaged plies when lifted from the stack.

According to the above features, from a broad aspect, the present invention provides a fabric picking device for transferring one or more top fabric plies from a stack of such plies. The device comprises a support body having a fabric engaging end. Means is provided to displace the housing toward the stack to position the fabric engaging end on an uppermost ply of the stack. At least two picking needles are supported by the body. Each of the needles has a pointed engaging end portion. The needles are disposed in opposed offset facing relationship and at a shallow angle with respect to the plane of the uppermost ply, with the pointed engaging end portion retracted inside the fabric engaging end. Actuating means is provided for moving the fabric engaging end of the needles a predetermined distance outwardly of the fabric engaging end, with the fabric engaging ends crossing one another, and wherein the needles will penetrate in each of the one or more uppermost fabric plies.

According to a further feature of the present invention there is provided the fabric picking and transferring device above described in combination with a separating device which is displaceable with respect to the body of the picking and transferring device. The separating device has a pressure bias fabric retention needle disposed transversely with respect to the fabric engaging front end and has a ply retention free end portion extending forwardly of the fabric engaging end. The needle has an axial pressure biasing force which is sufficient to penetrate through the truly engaged uppermost predetermined number of plies when lifted off the stack, but insufficient to penetrate through any ply when supported on the stack.

Another feature of the present invention is to provide a method of picking and transferring one or more top fabric plies from a stack of such plies. The method comprises adjusting the penetration length of at least two needles displaceably secured in a support body. A fabric engaging end of the body is positioned against an uppermost ply of a stack. A pointed engaging end of the at least two needles is advanced a predetermined distance out of the engaging end. The at least two needles are disposed in opposed offset facing relationship and at a shallow angle with respect to the plane of the uppermost ply. The needles cross one another adjacent their free ends and penetrate in each of the one or more uppermost fabric plies. Finally, the method comprises retracting the support body from the stack with the engaged one or more top fabric plies.

According to a further broad aspect of the present invention there is provided a fabric separating device for preventing underlying fabric plies under one or more engaged uppermost fabric plies in a stack of such plies from adhering to the engaged fabric plies when lifted from a stack of such plies. The fabric separating device comprises a pressure bias fabric retention needle disposed transversely with respect to an uppermost ply on a stack. The pressure bias fabric retention needle has as axial pressure biasing force which is applied thereto, and which is sufficient to penetrate at least one ply when freely held against a tip of the needle but insufficient to penetrate the uppermost ply when supported on the stack.

BRIEF DESCRIPTION OF DRAWINGS

A preferred embodiment of the present invention will now be described with reference to the accompanying drawings in which:

FIGS. 8, 9 and 10 are section views showing the operation of the separating device;

FIG. 14 is a schematic representation showing the effect of multi-plies on needle penetration.

Figure 3:
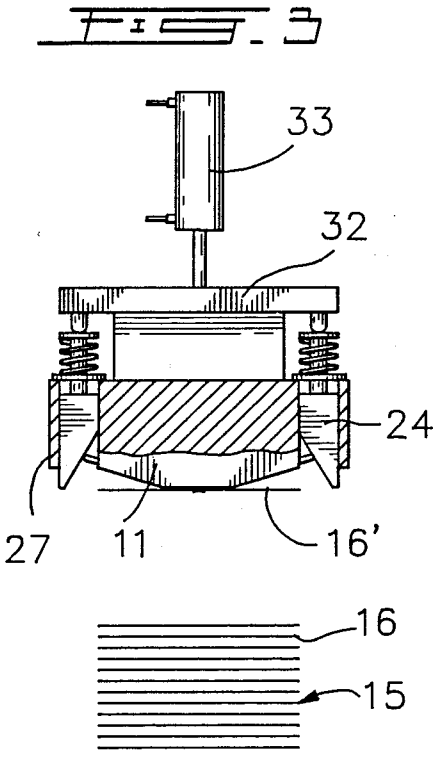
FIG. 3 is an end view of the picking and transferring device of the present invention showing an uppermost fabric ply engaged by the picking needles.

DESCRIPTION OF PREFERRED EMBODIMENTS:

Referring to the drawings, and more particularly to FIGS. 1 to 4, there is shown generally at 10 the fabric picking and transferring device of the present invention. As herein shown, the device comprises a support body 11 having a fabric engaging end 12. Means, as will be described with reference to FIG. 5, displace the support body 11 toward and away from a stack 15 of fabric plies 16 whereby to position the fabric engaging end 12 of the body 11 on an uppermost ply 16' of the stack 15.

Figure 2:
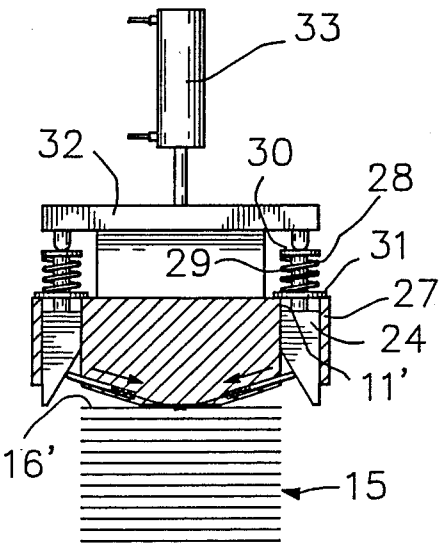
FIG. 2 is an end view as shown in FIG. 1, partly fragmented, and showing the picking needles in their engaging position.
Figure 1:
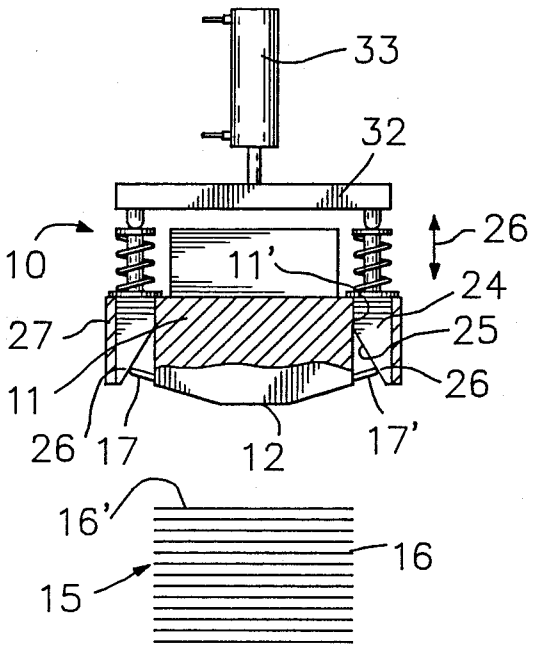
FIG. 1 is an end view showing the fabric picking and transferring device of the present invention positioned over a stack of fabric plies.
Figure 7:
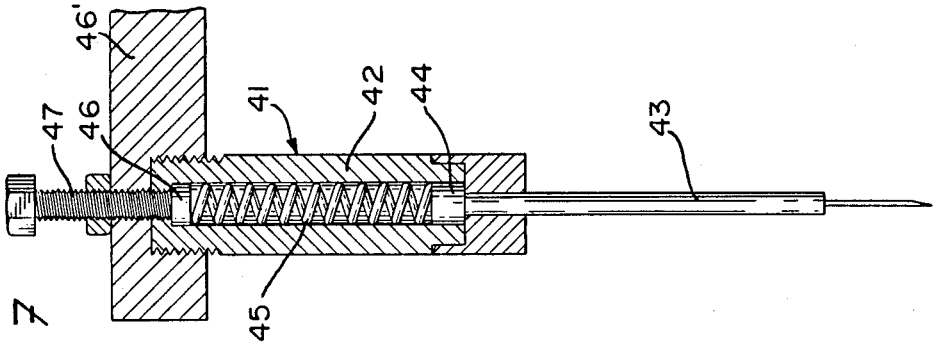
FIG. 7 is an enlarged section view of the separating device.
Figure 4:
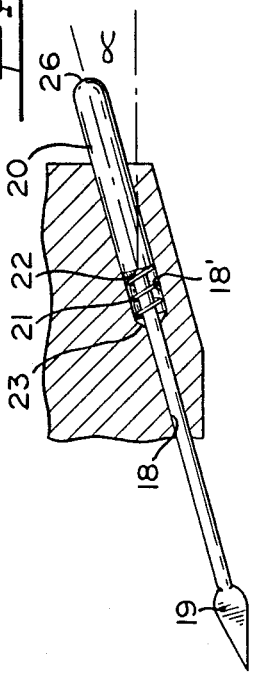
FIG. 4 is an enlarged fragmented section view showing the construction of the picking needle.

At least two picking needles 17 and 17' are supported in the body 11 in needle cavities 18 (see FIG. 4). Each of the needles 17 and 17' has a pointed engaging end portion 19 and a body portion 20. These needles, as more clearly shown in FIGS. 2 and 4, are disposed in opposed offset facing relationship and have a shallow angle $\alpha$, in the range of about 15° with respect to the plane of the uppermost ply 16'. When not actuated, the needles have their pointed engaging end portion 19 retracted inside the support body and the fabric engaging end 12.

As can be seen, the fabric engaging end 12 is a flat end portion and has needle holes therein, and out of which the pointed engaging end portion 19 of the needles protrude when the needles are actuated. These pointed ends are displaceable in and out of these holes. As shown in FIG. 4, the needles are biased in a retracted position by means of helical springs 21 disposed about each needle and between a forward shoulder portion 22 formed in the forward end of the body portion 20, and a further shoulder portion 23 formed by an enlarged rear needle cavity portion 18'. Accordingly, the springs 21 biases the needles in a normal retracted position.

In order to move the needles out of the fabric engaging end 12, there is provided actuating means, as herein shown in the form of piston heads 24, having a chamfered surface 25 which is engageable with a free engaging end 26 of the needles 17 and 17' to displace the needles axially as the surface 25 advances. The piston heads are movable in the direction of arrow 26 a predetermined distance whereby to move the needles 17 and 17' inwardly of the body 11 with the needle engaging ends protruding a predetermined distance outside the fabric engaging end surface 12. The distance of movement of the needle is calculated on the thickness of the ply of fabric to be picked. Preferably, the needles are each advanced a distance which is about four times the thickness of each ply that it must penetrate to provide positive engagement of the one or more plies that it must engage. Because of the shallow angle of attack of the needle, the fabric is positively engaged.

Figure 6:
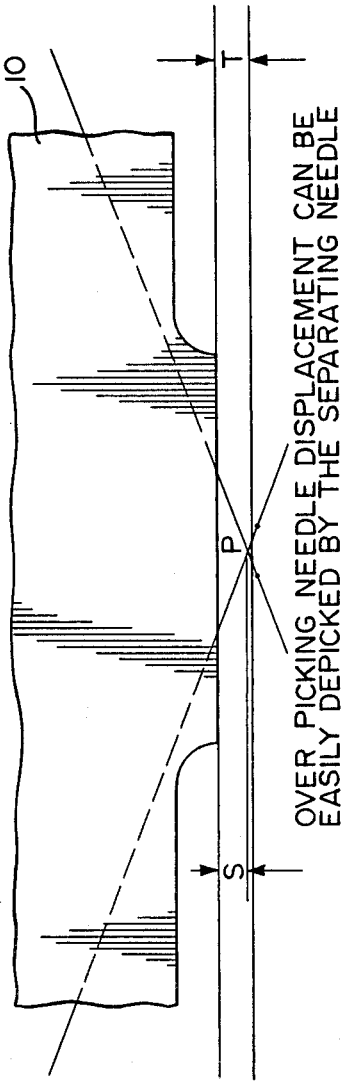
FIG. 6 is a fragmented view illustrating the picking range of a pair of needles.
Figures 11, 12, 13:
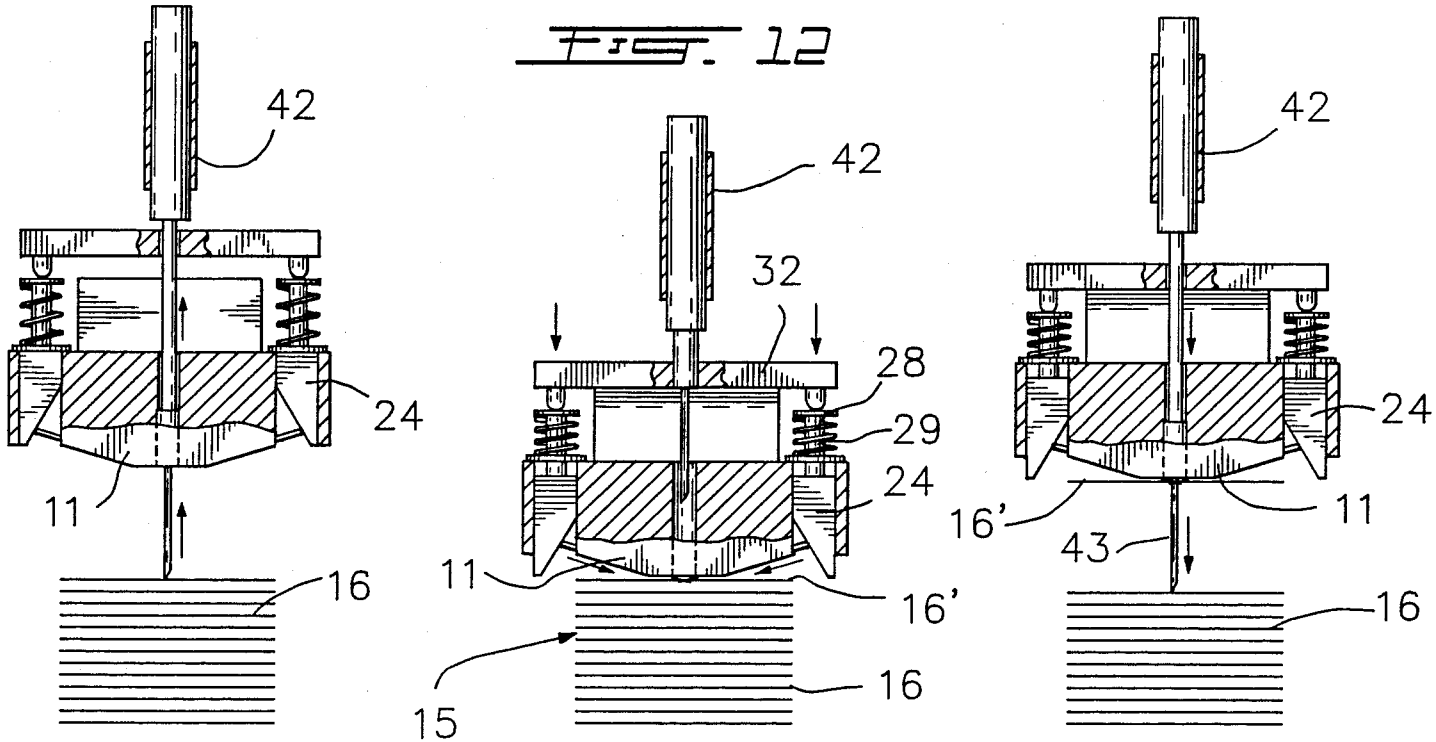
FIGS. 11, 12 and 13 are end views showing the operation of the combination of the picking and transferring device in combination with the separating device, and showing the combined operation thereof.

FIG. 6 illustrates the picking efficiency by properly selecting the location of the intersection point (P) of a pair of picking needles. By selecting the distance (S) between the lower surface of the picking device support body and the intersecting point (P) of each shallow angulated picking needle pair, we may securely engage a predetermined number of uppermost plies of total thickness (T). The distance (S) should be more than zero and less than or equal to (T).

As shown in FIGS. 2 and 3, each of the piston heads 24 is supported in guided alignment between an end wall 11' of the support body 11 and a guide plate 27. These piston heads are also biased in a retracted position by means of helical springs 28 positioned about the piston rod 29 and between an end shoulder plate 30 and a stationary ring or shoulder 31. The piston heads are displaced in unison by a rack 32 connected to an actuating piston 33. The piston heads, as herein shown, are of square cross-section and are guided in channels formed with the opposed end walls of the body 11 and the guide plates 27 which form channels for these piston heads. The piston 33 is a double acting piston having an adjustable controlled stroke whereby to advance the needle a predetermined distance out of the fabric engaging end surface 12, for the reason as above described. The piston 33 may be pneumatically or hydraulically actuated.

Figure 5:
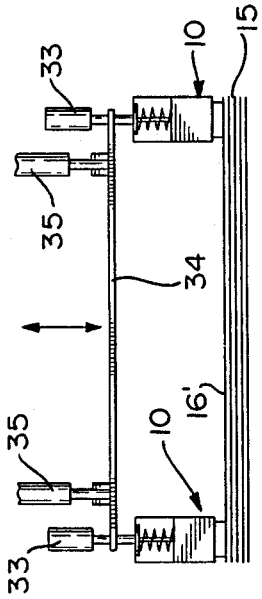
FIG. 5 is a front view showing a pair of fabric picking and transferring devices positioned over a stack of fabric plies.

Referring now to FIG. 5, there is shown a picking and transferring system utilizing two of the devices 10 of the present invention, and each of which is secured to a common frame 34 which is displaceable by one or more actuation means or pistons 35. The operation of the system is better illustrated in FIGS. 1 to 3, and as herein shown, the body 11 is first positioned on the upper ply 16' of the stack 15 to apply pressure on the stack and the needles are then actuated, as shown in FIG. 2, whereby to engage the upper ply. After the upper ply is engaged, the system then retracts the body 11, as shown in FIG. 3, with the top ply 16' having been engaged, and is now ready to be transferred to a remote location.

When utilizing particular fabric materials, it often occurs that when picking a top ply from a stack the underlying plies will adhere to the top ply, or be displaced thereby. In order to prevent underlying plies from adhering to the engaged top ply, a separating device is utilized in combination with the picking and transferring device 10. It consists of one or more separating needles 41 which are moved independently, but in synchronism with the operation of the fabric picking and transferring device 10.

Referring now additionally to FIGS. 7 to 10, there is shown the construction of the separating device 41 as comprising a piston body 42 having a pressure bias fabric retention needle 43 displaceable therein. The needle has a piston head 44 displaceably retained in the piston body 42 and normally biased axially forward out of the piston body 42 by means of a helical spring 45 located within the piston body or by air pressure. The air pressure or the helical spring 45 is adjustable by displacing a movable end wall disc 46 which is in engagement with a threaded bolt 47. By displacing the end wall 46 inwardly of the piston body, more pressure is applied against the needle and accordingly more axial pressure will be applied on the fabric pieces, for the reason as discussed hereinbelow.

As shown in FIGS. 8, 9 and 10, the piston head 44 of the needle may also be displaced by pneumatic or hydraulic fluid applied to a lower end coupling 48 or a top end coupling 49 to displace the piston 44 therein. To retract the needle a pressure would be applied at the lower end 48 of the piston body 42 and be sufficient to exceed the pressure at the top end. The axial pressure on the needle would be controlled by controlling the amount of pressure applied to the top end of the cylinder 42.

Referring again to FIGS. 8, 9 and 10, there will be described the operation of the separating needle device 41. Firstly, it is important to note that the axial pressure biasing force applied on the needle must be sufficient to penetrate at least one of the plies 16 when a ply is freely held against the tip 43' of the needle, but insufficient to penetrate through any of the uppermost plies 16' when supported on the stack, for the reason that the stack offers more resistance to penetration. This is illustrated by FIG. 14. Accordingly, when the separating device is used in combination with the picking and transferring device 10, the separating needle is placed on the uppermost ply and pressure biased thereagainst. The picking and transferring device then engages the top or the top two or more plies and lifts these plies with the separating needles 43 and its support structure remaining stationary. The top fabric ply or plies are then retracted a first distance, such as the position of the ply as shown at 45 in FIG. 10, with the force on the needle being sufficient to penetrate the top ply 16' or a few top plies due to the fact that there is no more backing resistance behind the top ply(ies), and it only has to penetrate into one ply or a few plies. At this position 45 the fabric picking and transferring device 10 and the separating needle assembly 40 will be displaced in unison to discharge the engaged fabric ply. As above described, the axial pressure on the needle must be adjusted to suit the particular fabric texture or the resistance force of the fabric whenever the fabric is changed to make sure that the force is sufficient to penetrate at least one of these plies when supported freely against the needle end. It is also pointed out that there may be several of these separating needles associated with a picking and transferring device depending on the configuration of the fabric piece, the number of picking and transferring devices 10 utilized in the assembly, such as in FIG. 5, and the nature of the fabric, that is to say, if the fabric plies are more susceptible to adhering to one another.

Briefly summarizing the method, it comprises firstly in adjusting the penetration length of the picking needles 17 depending on how many plies are to be engaged and on the thickness of each ply. Thereafter, the fabric engaging end of the picker body is positioned against the uppermost ply of the stack. Pressure may then be applied to the body to compress the stack. The pointed engaging ends 19 of the needles 17 are then advanced out of the engaging end in an opposed offset facing relationship and at a shallow angle of about 15° with respect to the plane of the uppermost ply, whereby the needles penetrate the uppermost predetermined fabric ply or plies a distance into the fabric. At this step or the previous step the separating needles 43 are positioned against the upper ply with its predetermined axial force applied thereto. The picking and transferring device 10 is then lifted a first predetermined distance with the separating needles 43 penetrating the engaged top fabric ply or plies and maintaining pressure on the underlying plies to prevent them from adhering to the engaged ply. Thereafter the picking and transferring device as well as the separating needles are displaced in unison to discharge the engaged ply or plies at a remote location.

It is within the ambit of the present invention to cover any obvious modifications of the examples of the preferred embodiment described herein, provided such modifications fall within the scope of the appended claims.

I claim:

1. A fabric picking and transferring device for transferring one or more top fabric plies from a stack of such plies, said device comprising a support body having a fabric engaging end, means to displace said support body toward said stack to position said fabric engaging end on an uppermost ply of said stack, at least two picking needles supported by said body, said needles each having a pointed engaging end portion, said needles being disposed side by side in opposed offset facing relationship and at a shallow angle with respect to the plane of said uppermost ply with said pointed engaging end portion retracted inside said fabric engaging end, actuating means for moving said fabric engaging end of said needles a predetermined distance outwardly of said fabric engaging end with said fabric engaging end portions cross one another with said needles penetrating in each of said one or more uppermost fabric plies to positively engage said one or more fabric plies and a separating device displaceable with respect to said body and having a pressure biased fabric retention needle disposed transversely with respect to said fabric engaging end of said support body and having a ply retention free end portion extending forwardly of said fabric engaging end, said needle having an axial pressure biasing force sufficient to penetrate at least one ply when freely held against a tip of said free end portion but insufficient to penetrate said uppermost ply when supported on said stack.

2. A device as claimed in claim 1 wherein said shallow angle is about 15° from said plane of said uppermost one of said fabric plies to be transferred.

3. A device as claimed in claim 2 wherein said distance of penetration of each said needles into each of said one or more top fabric plies is about four times the thickness of said ply.

4. A device as claimed in claim 1 wherein said fabric engaging end of said body is a flat engaging surface, said fabric engaging end of said needles being displaceable in and out of needle holes extending from said flat engaging surface.

5. A device as claimed in claim 4 wherein said at least two picking needles also have an enlarged body portion and are spring biased in respective ones of said needle holes.

6. A device as claimed in claim 5 wherein said body portion of each said needles is an enlarged diameter needle portion having a free engaging end protruding outside an exit end of its said needle hole, said actuating means being one or more piston heads each associated with a respective one of said needles, each head having a chamfered surface engageable with said free engaging end of its associated needle, means to displace said piston heads in unison to advance said chamfered surface a predetermined distance against said needles to displace said needles said predetermined distance outwardly of said fabric engaging end.

7. A device as claimed in claim 6 wherein said needle holes extend from said flat engaging surface to respective ones of opposed end walls of said housing extending parallel to one another and transversely of said flat engaging surface, said piston heads being displaceable over said end walls and over said exit end of said needle holes.

8. A device as claimed in claim 7 wherein each said needle holes has a smaller diameter in a section thereof adjacent said flat engaging surface of said housing, and a helical spring disposed about said pointed engaging end portion and abutting at one end a shoulder wall inwardly of said needle hole about said smaller diameter section and at an opposed end a shoulder defined by said enlarged diameter needle portion.

9. A device as claimed in claim 8 wherein said piston heads are displaceable along guide means formed in said opposed end walls of said housing, said piston heads being connected to an actuable displacing element through a common linkage whereby said needles are displaced out of said fabric engaging end in unison and the same predetermined distance.

10. A device as claimed in claim 9 wherein said guide means is a channel of square cross-section formed in said opposed end walls, said piston heads having a square cross-section and displaceably guided in a respective channel, said piston heads each having a piston shaft, a helical spring about said shaft to bias said piston head to a retracted position where said pointed engaging end portion of said needle is retracted inside said fabric engaging end.

11. A device as claimed in claim 1 wherein said actuating means is a double acting piston having a controlled stroke, there being one of said pistons connected to each of said needles to advance said needle a predetermined distance out of said fabric engaging end and to retract them therein.

12. A device as claimed in claim 11 wherein said piston is a pneumatically operated piston.

13. A device as claimed in claim 11 wherein said piston is a hydraulically operated piston.

14. A device as claimed in claim 1 wherein said pressure biasing force is sufficient to penetrate a predetermined number of said outermost plies when independently pushed against said tip of said free end portion.

15. A device as claimed in claim 1 wherein said fabric retention needle is connected to a support member for reciprocating movement of said needle therewith, pressure applying means associated with a rear end of said needle, and means to adjust the pressure of said pressure applying means to a predetermined force depending on the penetration resistance of said ply.

16. A device as claimed in claim 15 wherein said fabric retention needle rear end is slidingly retained in a piston cylinder and axially displaceable therein, said cylinder being connected to a support structure which is movable independently of said fabric picking and transferring device.

17. A device as claimed in claim 16 wherein said pressure applying means is a helical spring disposed in said piston cylinder, a lower end of said spring abutting against a piston head formed at said rear end of said needle, an upper end of said spring abutting against an axially adjustable wall, and a threaded shaft member for displacing said adjustable wall to adjust the pressure to a required pressure for said spring on said needle.

18. A device as claimed in claim 16 wherein said pressure applying means is a fluid pressure hose connected to said cylinder and applying controlled fluid pressure on a piston head formed at said rear end of said needle.

19. A device as claimed in claim 18 wherein said cylinder has a fluid port in opposed end portions of said cylinder on a respective side of said piston head, said pressure at a lower end of said cylinder causing said needle to retract in said cylinder and being applied when said fabric picking and separating device is lifted with one or more fabric plies engaged thereby.

20. A device as claimed in claim 15 wherein there are two or more of said fabric retention needles associated with said fabric picking and separating device, said needles being spaced apart at predetermined positions.

21. A method of picking and separating one or more top fabric plies from a stack of such plies, said method comprising:

(i) adjusting the penetration length of at least two needles displaceably secured in a support body;

(ii) positioning a fabric engaging end of said body against an uppermost ply of said stack;

(iii) advancing a pointed engaging end of said at least two needles a predetermined distance out of said engaging end; said at least two needles being disposed in side-by-side opposed offset facing relationship and at a shallow angle with respect to the plane of said uppermost ply, said needles crossing one another adjacent their free ends and penetrating in each of said one or more uppermost fabric plies;

(iv) positioning one or more fabric retention needles transversely against said uppermost ply with said retention needles having an axial pressure biasing force sufficient to penetrate at least one ply of said stack when independently pushed against a pointed end of said retention needles but insufficient to penetrate said outermost ply when supported on said stack;

(v) retracting said support body from said stack a first predetermined distance;

(vi) retracting said fabric retention needles; and (vii) transferring said support body and engaged uppermost fabric ply(ies) to an unloading position.

22. A method as claimed in claim 21 wherein said needles are pressure biased in a retracted position inwardly of said fabric engaging end, said step (ii) comprising applying a predetermined forward force on a free engaging end of said needles opposite said pointed engaging end to displace said needles against said pressure bias.

23. A fabric separating device for preventing underlying plies under one or more engaged uppermost plies in a stack of such plies from adhering to said engaged plies when lifted from a stack of fabric plies, said fabric separating device comprising a pressure biased fabric retention needle disposed transversely with respect to an uppermost ply on said stack, said pressure biased fabric retention needle having an axial pressure biasing force applied thereto sufficient to penetrate at least one ply when freely held against a tip of said needle but insufficient to penetrate said uppermost ply when supported on said stack.

24. A fabric separating device as claimed in claim 23 wherein said pressure biasing force is sufficient to penetrate a predetermined number of said outermost plies when independently pushed against said tip of said free end portion.

25. A fabric separating device as claimed in claim 23 wherein said fabric retention needle is connected to a support member for reciprocating movement of said needle therewith, pressure applying means associated with a rear end of said needle, and means to adjust the pressure of said pressure applying means to a predetermined force depending on the penetration resistance of said ply.

26. A fabric separating device as claimed in claim 25 wherein said fabric retention needle rear end is slidingly retained in a piston cylinder and axially displaceable therein, said cylinder being connected to a support structure which is movable independently of a fabric picking and transferring device.

27. A fabric separating device as claimed in claim 26 wherein said pressure applying means is a helical spring disposed in said piston cylinder, a lower end of said spring abutting against a piston head formed at said rear end of said needle, an upper end of said spring abutting against an axially adjustable wall, and a threaded shaft member for displacing said adjustable wall to vary the pressure of said spring on said needle.

28. A fabric separating device as claimed in claim 26 wherein said pressure applying means is a fluid pressure hose connected to said cylinder and applying controlled fluid pressure on a piston head formed at said rear end of said needle.

29. A fabric separating device as claimed in claim 28 wherein said cylinder has a fluid port in opposed end portions of said cylinder to a respective side of said piston head, said pressure at a lower end of said cylinder causing said needle to retract in said cylinder and being applied when said fabric picking and transferring device is lifted with one or more fabric plies engaged thereby.

* * * * *